United States Patent [19]

Pawlowski

[11] 4,377,237

[45] Mar. 22, 1983

[54] MULTIPLE COMPARTMENT CARTON

[75] Inventor: Thomas D. Pawlowski, Neenah, Wis.

[73] Assignee: James River-Dixie/Northern, Inc., Greenwich, Conn.

[21] Appl. No.: 241,573

[22] Filed: Mar. 10, 1981

[51] Int. Cl.[3] ..... B65D 17/40

[52] U.S. Cl. ..... 206/630; 229/27; 229/15

[58] Field of Search ..... 206/602, 604, 605, 608, 206/630, 273, 620; 229/27.15, 44 CB, 15

[56] References Cited

U.S. PATENT DOCUMENTS

| | | | |
|---|---|---|---|
| 2,669,380 | 2/1954 | Grenier | 229/15 |
| 2,710,130 | 6/1955 | Grecco | 229/15 |
| 2,771,234 | 11/1956 | Hultin | 229/15 |
| 3,092,301 | 6/1963 | Selle | 206/602 |
| 3,135,457 | 6/1964 | Risucci | 206/602 |

*Primary Examiner*—William Price
*Assistant Examiner*—Jimmy G. Foster
*Attorney, Agent, or Firm*—Harry W. Hargis, III

[57] ABSTRACT

In a multiple compartment carton, one compartment has a line of weakness for opening the compartment. Protective means overlies the line of weakness, to prevent inadvertent breakage of the line of weakness.

6 Claims, 6 Drawing Figures

FIG.3
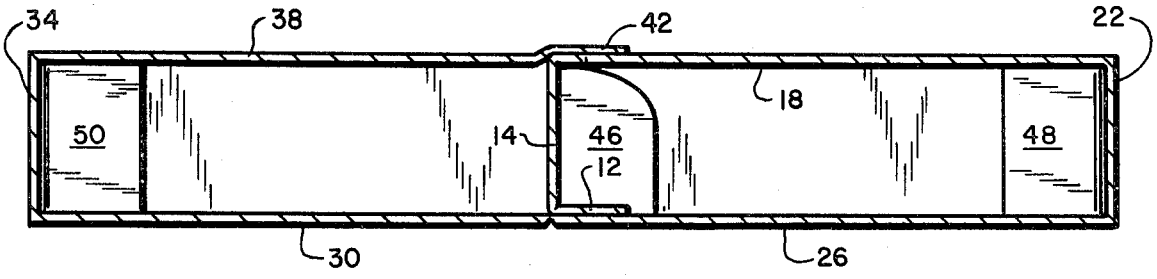
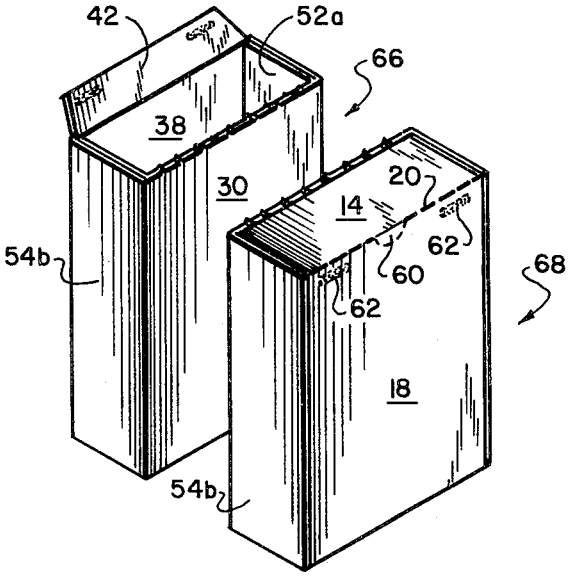
FIG.5
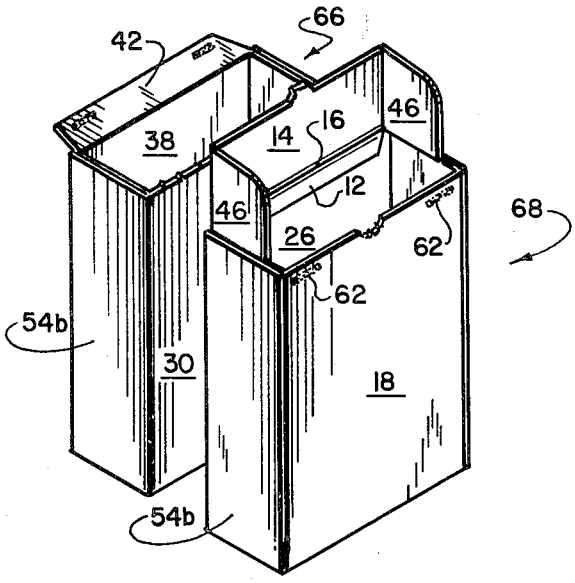
FIG.6

MULTIPLE COMPARTMENT CARTON

BACKGROUND OF THE INVENTION

This invention is an improvement in multiple compartment cartons such as are used to package and protect multiple units of individual servings of food. It is desirable that one unit may be removed from the package without damage to a remaining unit, and without opening the remaining unit. It is further desirable for the packager to be able to select a predetermined one of the multiple units which should be removed and opened first; to enhance its ease of first removal and opening, and to make it difficult to open a non-selected unit.

SUMMARY OF THE INVENTION

The invention is embodied in a multiple compartment carton, preferrably formed from a unitary blank, and having a first compartment and a second compartment. The second compartment has a first line of weakness for opening the second compartment, and protective means overlying the line of weakness.

The first compartment may be separable from the second compartment after the carton is set up and closed, the protective means being removed during the separation to expose the first line of weakness, the second compartment remaining closed after the separation.

The first line of weakness defines one edge of a cover on the second compartment. The first line of weakness, in the unopened carton, joins the cover to a carton wall panel, the protective means being affixed to the wall panel.

The first and second compartments are joined by a second line of weakness, such that the first compartment may be opened by releasing the affixation of the protective means and tearing the first compartment from the second compartment at the second line of weakness.

The invention is further embodied in a carton blank made of sheet material and suitable for erection into a multiple-compartment carton, the blank comprising top and bottom wall panels, end wall panels and glue flaps connected to each other by hinge lines along opposing edges. The sequence of elements is: a first glue flap, a first end wall panel, a first top wall panel, a second end wall panel, a first bottom wall panel, a second bottom wall panel, a third end wall panel, a second top wall panel, and a second glue flap. The hinge line between the first end wall panel and the first top wall panel has a first line of weakness on it. The hinge line between the first and second bottom wall panels is a second line of weakness.

BRIEF DESCRIPTION OF THE DRAWINGS

FIG. 3 is a cross-section taken at 3—3 of FIG. 2.

FIG. 5 shows the two compartments fully separated with the second compartment still closed.

FIG. 6 shows the two compartments fully separated with the second compartment open.

DETAILED DESCRIPTION OF THE ILLUSTRATED EMBODIMENT

Figure 1:
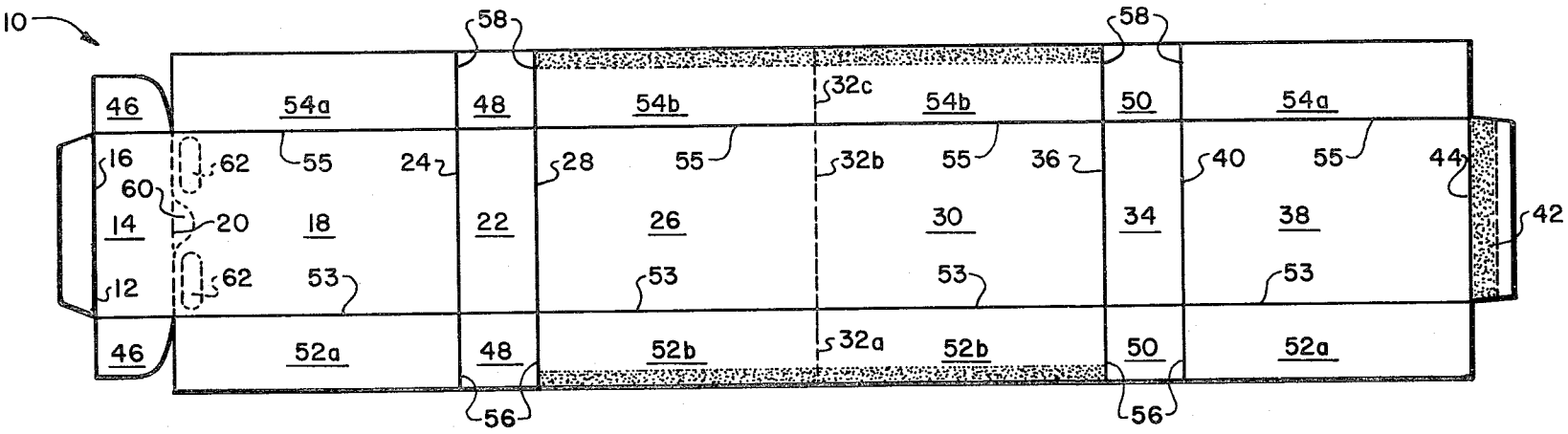
FIG. 1 is a plan view of a blank of a carton of this invention.

FIG. 1 shows a carton blank of this invention with the top surface which will be on the inside of the finished carton facing upwardly. The blank has top and bottom wall panels, and glue flaps connected to each other by hinge lines along opposing edges. Dust flaps depend from the end wall panels, and sidewall panels depend from the top and bottom wall panels.

The carton blank is generally designated 10. A first glue flap 12 is connected to a first end wall panel 14 by hinge line 16. A first top wall panel 18 is connected to end wall panel 14 by hinge line 20. Second end wall panel 22 is connected to first top wall panel 18 by hinge line 24. First bottom wall panel 26 is connected to second end wall panel 22 by hinge line 28. Second bottom wall panel 30 is connected to a first bottom wall panel 26 by hinge line 32, line 32 having segments 32*a*, 32*b* and 32*c*. Third end wall panel 34 is connected to second bottom wall panel 30 by hinge line 36. Second top wall panel 38 is connected to third end wall panel 34 by hinge line 40. Second glue flap 42 is connected to second top wall panel 38 by hinge line 44. Dust flaps 46, 48 and 50 depend from end wall panels 14, 22 and 34 respectively. Sidewall panels 52 and 54 depend from panels 18, 26, 30 and 38, by means of hinge lines 53 and 55 respectively.

Hinge line 32 is a line of perforations extending from the outside edge of panels 52 to the outside edge of panels 54. Cut lines 56 and 58 respectively extend from the outside edges of sidewall panels 52 and 54 respectively to hinge lines 53 and 55 respectively, separating the dust flaps from the sidewall panels.

Hinge line 20 is, for most of its length, a line of perforations. The line of perforations deviates from hinge line 20 to form tab 60, whose function will be appreciated by means of discussion following. Adjacent hinge line 20, on the bottom surface of the blank, are glue receptive areas 62, shown in phantom outline. Areas 62 are generally defined by circumferential cut scores which extend at least through the surface of the blank material.

In gluing the carton, glue is first applied, or activated, at the outside surface of glue flap 12. Glue flap 12 and end panel 14 are then folded about hinge line 20 onto top wall panel 18. Panels 12, 14, 18, and 22 are then folded about hinge line 28 onto panels 26 and 30, with glue flaps 12 and end wall panel 14 to the inside of the fold. This folding brings the glue on glue flap 12 in contact with bottom wall panel 26 near hinge line 32, adhering it to panel 26. Glue is then applied or activated at the inside surface of glue flap 42, and glue flap 42 and top wall panel 38 are folded about hinge line 40 and onto the previously folded structure.

At this point top wall panel 38 overlies end wall panel 34 and bottom wall panel 30. Importantly, the glue on glue flap 42 is in contact with, and adhered to top wall panel 18 in adhesive receptive areas 62.

The glued blank is erected by pushing simultaneously against hinge lines 40 and 28. After product is inserted, the carton is closed and sealed by folding in dust flaps 46, 48, and 50, folding in panels 52*a* and 54*a*, applying, or activating, glue, as in FIG. 1 at the inside surface of the outer edges of panels 52*b* and 54*b*, and folding panels 52*b* and 54*b* against panels 52*a* and 54*a*. It is significant to note that glue flap 42 overlies the line of perforations generally following hinge line 20, and protects it.

Figure 2:
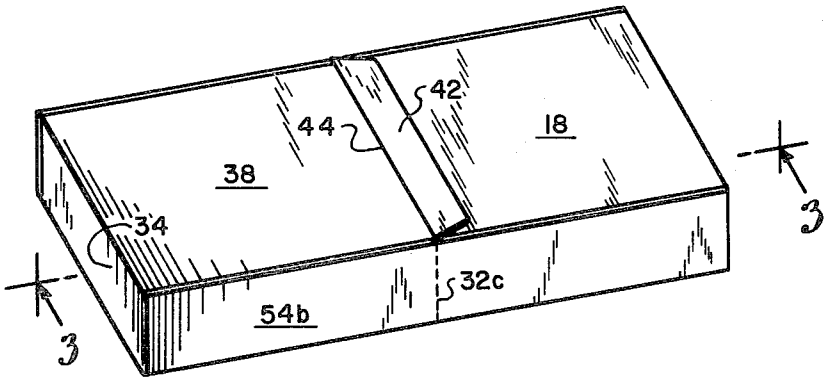
FIG. 2 is a perspective view of a closed and sealed carton made from the blank of FIG. 1.

The completely closed and sealed carton is shown in FIG. 2. FIG. 3 shows a cross-section of FIG. 2, there being no product shown, in order to better illustrate the various elements in the carton. Note that both compartments share a common wall in wall panel 14.

Figure 4:
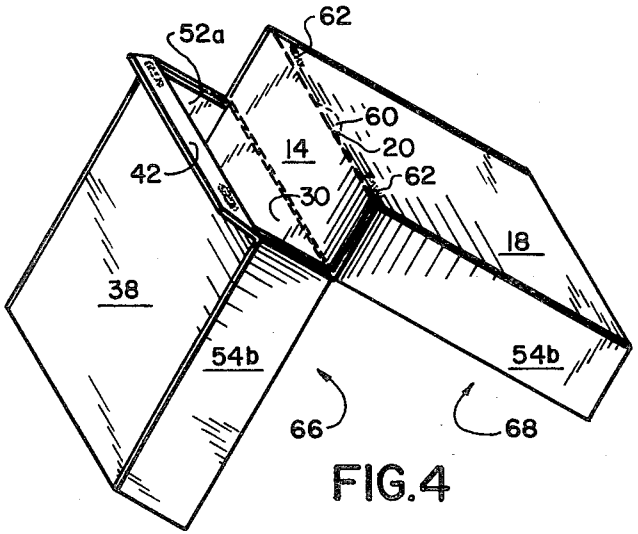
FIG. 4 shows the carton of FIG. 1 with one compartment being broken away.

The carton is desirably opened with a high degree of control by first lifting glue flap 42, tearing it from top wall panel 18. Rotation of the two ends of the carton about hinge line 32*b*, as shown in FIG. 4 breaks perforation lines 32*a* and 32*c*, exposing the contents of the first compartment 66, which is generally defined by panels 30, 34, 38, 52 and 54. As the package is opened, end wall panel 14 remains with the second compartment, and is separated from the first compartment. Thus the opening of the carton is effective in opening the first compartment. The first compartment 66 may then be entirely separated from the second compartment 68 by tearing along line of weakness 32*b*. The separated compartments are shown in FIG. 5. At this point, the first compartment 66 is fully opened with the contents, if any, exposed. The second compartment 68 remains completely closed and sealed, providing substantially the same degree of protection to its contents as does the unitary carton as shown in FIG. 2. When desired, the second compartment is opened by pushing in on tab 60 and lifting panel 14, thus breaking the perforations along hinge line 20. Panel 14 functions as a hinge cover, hinged about hinge line 16.

As described above, this invention provides a multiple compartment carton having individual access to the individual compartments by means of individual opening features. In the closed and sealed carton, the opening feature for opening the second compartment is hidden and protected until the first compartment has been opened. Thus it is virtually impossible to open the wrong compartment first, and the opening feature on the second compartment is protected against inadvertent damage or breakage. The same design responsible for these benefits also contributes to easily controlled opening of the compartments in the proper sequence.

Those skilled in the art will appreciate that the lines of perforations are merely illustrative of a variety of acceptable configurations for lines of weakness. Similarly the construction of adhesive receptive areas 62 is merely illustrative, and other similar constructed areas are contemplated.

Having thus described the invention, what is claimed is:

1. A multiple compartment carton, comprising: a first compartment and a second compartment, said second compartment having a first line of weakness for opening said second compartment, said first line of weakness defining one edge of a cover on said second compartment, said first line of weakness, in the unopened carton, joining said cover to a carton wall panel; and protective means overlying said first line of weakness and affixed to said wall panel.

2. A carton as in claim 1 wherein said first and second compartments are joined by a second line of weakness, such that said first compartment may be opened by releasing the affixation of said protective means and tearing said first compartment from said second compartment at said second line of weakness.

3. A carton blank made of sheet material and suitable for erection into a multiple-compartment carton, said blank comprising top and bottom wall panels, end wall panels and glue flaps, connected to each other by hinge lines along opposing edges, in the sequence of: a first glue flap, a first end wall panel, a first top wall panel, a second end wall panel, a first bottom wall panel, a second bottom wall panel, a third end wall panel, a second top wall panel, and a second glue flap; said hinge line between said first end wall panel and said first top wall panel having a first line of weakness thereon; said hinge line between said first and second bottom wall panels being a second line of weakness.

4. A carton blank as in claim 3 and including, on said first top wall panel an area substantially enclosed by cut means extending at least through the surface of the sheet material.

5. A carton blank as in claim 4 wherein said area is adjacent said first line of weakness.

6. A carton blank as in claim 4 or 5, said second glue flap having a length dimension between the hinge line between said second glue flap and said second top wall panel and an opposing free edge, said length dimensions being at least as great as the dimension extending between said hinge line between said first end wall panel and said first top wall panel and a remote edge of said area.

* * * * *